United States Patent [19]

Hanyu

[11] Patent Number: 4,602,583

[45] Date of Patent: Jul. 29, 1986

[54] PATTERN SELECTION DEVICE OF ELECTRONIC SEWING MACHINE

[75] Inventor: Susumu Hanyu, Hachioji, Japan

[73] Assignee: Janome Sewing Machine Industry Co., Ltd., Japan

[21] Appl. No.: 652,393

[22] Filed: Sep. 20, 1984

[30] Foreign Application Priority Data

Sep. 21, 1983 [JP] Japan ..... 58-145099[U]

[51] Int. Cl.[4] ..... D05B 3/02

[52] U.S. Cl. ..... 112/458; 112/445; 112/454

[58] Field of Search ..... 112/158 E, 121.11, 121.12, 112/158 F, 458, 453, 445, 444, 454, 457

[56] References Cited

U.S. PATENT DOCUMENTS

| | | | |
|---|---|---|---|
| 4,161,918 | 7/1979 | Dunn | 112/158 E |
| 4,236,467 | 12/1980 | Tanaka et al. | 112/158 F X |
| 4,323,022 | 4/1982 | Hanyu et al. | 112/158 E |
| 4,325,315 | 4/1982 | Totino et al. | 112/158 E X |
| 4,406,235 | 9/1983 | Eguchi | 112/158 E |
| 4,413,574 | 11/1983 | Hirota et al. | 112/158 E X |

FOREIGN PATENT DOCUMENTS

| | | | |
|---|---|---|---|
| 3304041 | 8/1983 | Fed. Rep. of Germany | 112/458 |
| 6096289 | 5/1985 | Japan | 112/121.11 |

*Primary Examiner*—Peter M. Nerbun

*Attorney, Agent, or Firm*—William A. Drucker

[57] ABSTRACT

An electronic sewing machine is operated to produce a stitch pattern or a sequence of plural stitch patterns, in response to corresponding stitch control data, which are stored in an electronic memory element of the sewing machine and read out in response to desired manual operation of a pattern selection device provided therein. The pattern selection device includes an operation panel arranged along a laterally extending bracket arm of the machine housing, on which a plurality of sheet switches for selecting alphabet and symbol patterns in reference to their representations shown on the sheet switches are neatly and efficiently arranged. The sheet switches may comprise two rows of pentagonal shaped switches arranged adjacent to each other, or may comprise three rows in which upper and lower rows comprise sheet switches of pentagonal shape and a middle row of regular hexagonal shaped switches is interposed therebetween. The three rows arrangement of sheet switches may preferably be modeled after the key arrangement of a typewriter for easier operation.

5 Claims, 2 Drawing Figures

PATTERN SELECTION DEVICE OF ELECTRONIC SEWING MACHINE

BACKGROUND OF THE INVENTION

This invention relates to an electronic sewing machine in general, and more particularly to a mechanism and arrangement of a pattern selection system of an electronic sewing machine.

In an electronic or computer sewing machine each stitch pattern is stored in the form of an electronic information specific thereto, in an electronic memory element, and may be read out by selecting and operating a corresponding key arranged adjacent each of the patterns diagrammatically represented on a front panel of a sewing machine housing, to thereby produce the pattern on a fabric material solely or in combination with other pattern or patterns. Meanwhile, recent developments in semiconductor technology have made it possible to considerably increase the capacity of the electronic memory element with the memory element remaining small and resulting in an increase in the number of keys in accordance with the representations of so many stitch patterns stored in the memory element and indicated in the limited space of the front panel of the sewing machine housing. Therefore, the panel is crowded with the keys and the pattern representations.

Thus, as generally known in the prior art, various stitch patterns stored in the electronic sewing machine are classified into two groups depending upon their frequency of use. More particularly, patterns of comparatively high frequency of use have their representations indicated on the front panel and may be directly selected in reference to their representations whereas the other patterns of less frequency of use have the diagramatic representations and the respective pattern numbers each indicated on the underside of a top cover plate of the sewing machine so that the patterns may be selected by operating ten-key switches arranged on the front panel to designate their specific pattern numbers. The operator may know a pattern and the pattern number specific thereto in reference to the list as indicated on the underside of the top cover plate hinged on the machine housing.

In the prior art, character or letter patterns such as alphabet characters and symbols such as period (.), hyphen (-) and question mark (?) are included in the second group of patterns because of their lesser frequency of use and therefore selected indirectly by operation of the ten-key switches to designate the corresponding pattern number. However, actually there may often arise the necessity of continuously stitching in series a plurality of character patterns and/or symbol patterns so as to produce a word or sentence. Such kind of combination stitch can, of course, be produced in the prior art manner. It has however been found troublesome and time-consuming that the ten-key switches are so operated as to select a series of the patterns in reference to the pattern representations and pattern numbers as indicated on the underside of the top cover plate of the sewing machine. This has often resulted in error of the pattern selection.

SUMMARY OF THE INVENTION

It is therefore an object of the invention to provide an electronic sewing machine capable of working without manifesting the defects and disadvantages which have often been encountered in the prior art.

Another object of the invention is to improve the accuracy and efficacy of pattern selection in an electronic sewing machine operation, especially when a plurality of character patterns are to be stitched in series to thereby produce a word or sentence on a fabric material workpiece.

Still another object of the invention is to provide an electronic sewing machine having a neat appearance on a front panel thereof.

According to an aspect of the invention there is provided a pattern selection device of an electronic sewing machine capable of producing a stitch pattern or a sequence of a plurality of stitch patterns in reference to stitch control data stored therein, comprising first pattern selecting means including a first group of operation keys to be operated to select a predetermined number of fundamental utility stitch patterns including a straight stitch pattern and a zigzag stitch pattern; second pattern selecting means including a second group of ten-key operation keys to be selectively operated to select ornamental stitch patterns by designating the patterns with the specific two-figure numbers; third pattern selecting means including a third group of sheet switches each representing different one of alphabet and symbol patterns, the sheet switches being arranged along a laterally extending bracket arm of the sewing machine and selectively operated to select the alphabet and symbol patterns; and pattern memorizing means including a pattern memorizing key operated to memorize a plurality of the stitch patterns to be selected so that the selected stitch patterns may be automatically and sequentially stitched.

BRIEF DESCRIPTION OF THE DRAWINGS

Further objects and advantages of the invention can be fully understood from the following detailed description when read in conjunction with the accompanying drawings in which.

PREFERRED EMBODIMENTS OF THE INVENTION

Figure 1:
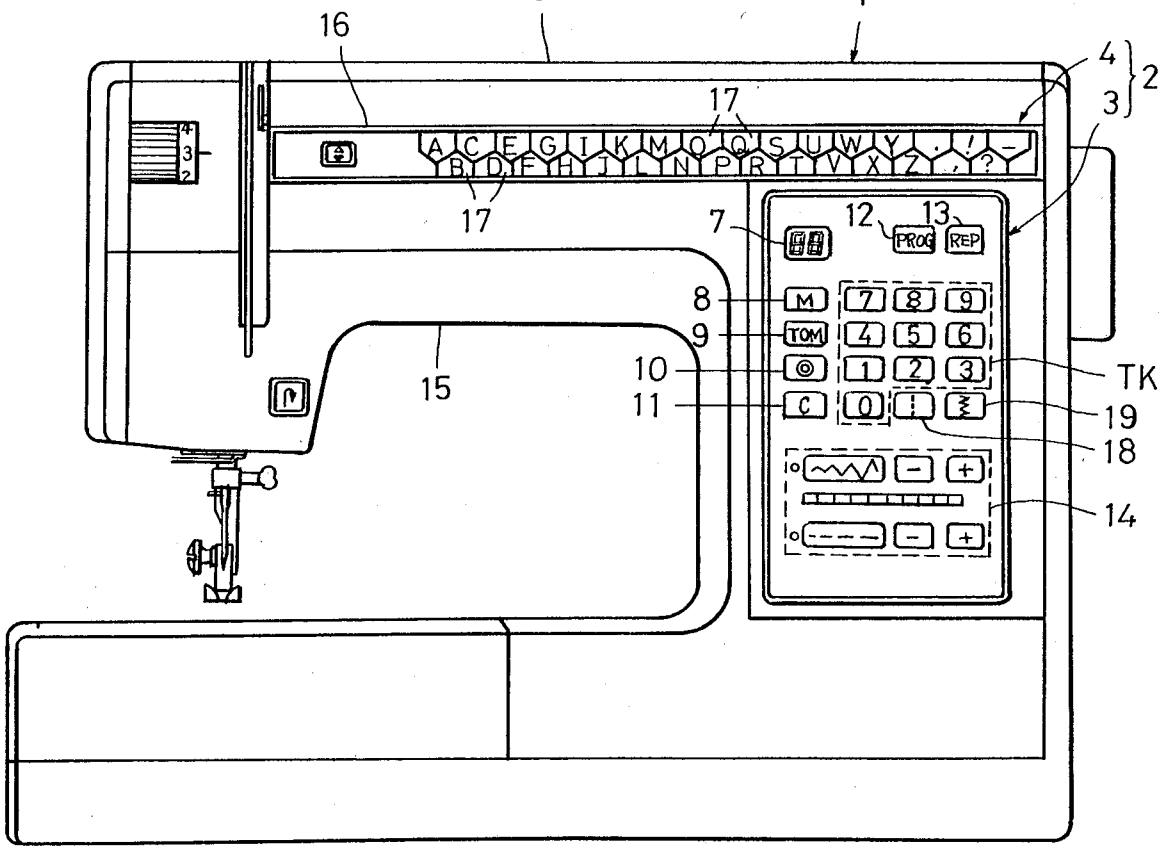
FIG. 1 is a front view of an electronic sewing machine embodying the invention.

With reference to FIG. 1, on a front face of an electronic sewing machine housing 1 is arranged a pattern selection device 2 which comprises a first pattern selection display 3 provided on a vertical standard of the machine housing 1 and a second pattern selection display 4 provided on a horizontally extending bracket arm 15.

In the first pattern selection display 3, keys 4 and 5 are arranged and may be operated to directly select a straight stitch pattern and a zigzag stitch pattern respectively. Ten-key switches (TK) are arranged and may be selectively operated to designate a pattern number of a two-figure digit which is predetermined to be specific to each one of stitch patterns stored in the electronic sewing machine and diagrammatically represented together with the respective pattern numbers in a list on the underside of a top cover plate 6 hinged on the housing 1. Thus, these patterns, which may be regarded as being not so frequently selected, will be selected by operating the ten-key switches (TK) for designating a selected pattern by its pattern number, at which time the selected pattern number of two-figures is illuminated in an indicator 7.

Numerals 8 through 13 are various function keys. More particularly, a memory key 8 is operated each time after one of the stitch patterns has been selected so that the desired combination of stitch patterns may be produced in series and in the designated order. Thus, the repeated operation of the memory key 8 in the pattern selection program will enable the sewing machine to memorize many patterns to be stitched in series and in the designated order. A turn-over memory key 9 may be operated in place of the memory key 8 to memorize the selected pattern in the form of a mirror image with respect to the right and left. With regard to the character patterns or symbol patterns which are selected by operation of the second pattern selection display 4 as will be described hereinlater, the operation of the turn-over memory key 9 in place of the memory key 8 will function to memorize the selected pattern in a reduced size, instead of memorizing the pattern in the form of a mirror image. A lock-stitch designating key 10 is operated in combination with the memory key 8 to produce a lock-stitch pattern, usually at the beginning and/or at the end of a pattern or a combination of patterns. The numeral 11 denotes a memory cancelling operation key for cancelling the whole or a part of a series of memory established by keys 8 or 9. A program confirmation key 13 may be kept as operated or the memory key 8 may be successively operated after the confirmation key 13 has been operated, to cause the selected pattern numbers to be sequentially illuminated in the indicator 7 to thereby confirm the selected pattern numbers. Re-operation of the confirmation key 13 returns the sewing machine to the normal stitching condition in which the selected and memorized patterns are sequentially stitched in the predetermined order as programmed. A program key 12 is used especially for memorizing a very large number of patterns in order, in such manner that after this key is operated a series of patterns may be sequentially selected by desired operation of the pattern selecting keys. This will render it unnecessary to operate the memory key 8 each time after one stitch pattern is selected. The numeral 14 identifies an operating section for manually adjusting the needle lateral amplitude and the fabric feeding amount of the selected pattern, which is substantially known in the prior art so that its detailed description is omitted.

The second pattern selection display 4 comprises a panel 16 attached to the bracket arm 15 and a plurality of pattern indicators 17 arranged on the panel 16. Each pattern indicator 17 consists of a sheet switch on which one of the alphabet characters and symbols is represented, which alphabet character or symbol may be directly selected by pushing the corresponding sheet switch 17 in reference to its pattern representation shown thereon. Each one of the alphabet and symbol patterns is also given a pattern number specific thereto for the confirmation purpose which is actuated by operation of the confirmation key 13. The pattern numbers of the character or symbol patterns may be respectively shown in the sheet switches 17 together with their representations, or alternatively may be included in the list shown on the underside of the top cover plate 6.

In the embodiment shown in FIG. 1, each pattern indicator 17 has a pentagonal shape so that many pattern indicators may be neatly and efficiently arranged adjacent to each other in a limited space of the panel 16.

The sewing machine of the invention will be operated as follows. A pattern of less frequency of use is selected by operating the ten-key switches (TK) to designate its pattern number of two figures in reference to the list on the underside of the top cover plate 16. In order to memorize a number of selected patterns in a desired order, the ten-key switches (TK) are repeatedly operated each in combination with a subsequent operation of the memory key 8 or operated in combination with the initial single operation of the program key 12. Some fundamental utility stitch patterns, that is, in general, a straight stitch pattern and a zigzag stitch pattern, can be directly selected by operating push keys 18, 19 respectively, which are arranged in the first pattern display in the embodiment shown in FIG. 1.

The character or symbol patterns can be directly selected by touching the corresponding sheet switches 17 in the second pattern selection display 4. When the program key 12 is first operated and then the sheet switches 17 are successively operated in a desired order, a plurality of character or symbol patterns are sequentially memorized so that a desired word or sentence may be automatically stitched.

The program thus designated by operation of the tenkey switches (TK) and/or sheet switches 17 in combination with the memory key 8 or program key 12 can be effectively confirmed at the indicator 7 by pushing the confirmation key 13, namely while the key 13 is kept as being pushed the selected pattern numbers are successively illuminated in the indicator 7. Alternatively, such program confirmation may be achieved by the initial operation of the key 13 and by the following repeated operation of the memory key 8, whereby each pattern number is indicated at the indicator 7 one by one. After confirming that the sequence of the patterns is correctly programmed, the key 13 is pushed again so that the sewing machine 1 becomes ready for stitching operation in accordance with the program.

The indicator 7 comprises a pair of 7-segment light emitting diodes (LED), but may be replaced by multi-segment LEDs or a dot matrix elements which will enable representation of alphabet characters and symbols in their natural forms. In this case, it will become unnecessary to predetermine a pattern number specific to each alphabet or symbol pattern.

Figure 2:
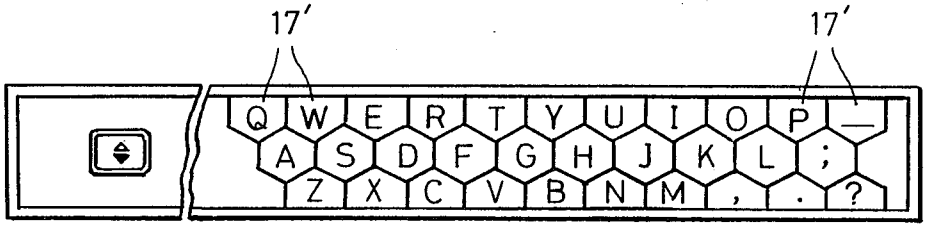
FIG. 2 is a diagrammatic view showing another embodiment of the invention.

The arrangement of sheet switches 17 in the second pattern selection display 4 can be modified to that shown in FIG. 2. According to this embodiment the second pattern selection display 4 comprises three rows of sheet switches in which pentagonel sheet switches are arranged adjacent to each other in the lateral direction in the upper and lower rows. Between the upper and lower rows the middle row of regular hexagonal shaped sheet switches are interposed. The arrangement of the sheet switches according to this embodiment is modeled on the key arrangement of a typewriter so that the switches 17' can be conveniently operated by a person skilled in typewriting.

Although the invention has been described in conjunction with some preferred embodiments thereof, it is to be understood that many different modifications and variations may be made without departing from the spirit of the invention as defined in the appended claims.

What is claimed is:

1. In an electronic sewing machine capable of producing a stitch pattern or a sequence of a plurality of stitch patterns in response to stitch control data stored therein, a pattern selection device for selecting said stitch pattern or patterns to be stitched comprising, in combination, first pattern selecting means including a first group of operating keys selectively operated with reference to the patterns indicated in combination with said operating keys to select most frequently selected fundamental utility stitch patterns including a straight stitch pattern and a zigzag stitch pattern;

second pattern selecting means including a second group of ten-key operation switches selectively operated with reference to two-figure numbers of patterns to be more frequently selected to select ornamental stitch patterns which are normally hidden but may be seen as desired;

a third pattern selecting means including a third group of sheet switches each representing a different one of alphabet characters and symbol patterns which may be frequently selected generally in series to form a representation having some meaning, said sheet switches being arranged along a laterally extending bracket arm of the sewing machine and selectively operated to select the alphabet characters and symbol patterns, said sheet switches including at least first and second rows of switches, each of the switches in the second row being arranged between the two adjacently arranged switches of the first row and pattern memorizing means including a pattern memorizing key operated to memorize a plurality of the stitch patterns to be stitched so that the selected stitch patterns may be automatically and sequentially stitched.

2. The pattern selection device according to claim 1 wherein said third selecting means comprises two rows of said sheet switches of pentagonal shape arranged adjacent to each other.

3. The pattern selection device according to claim 1 wherein said third selecting means comprises three rows of said sheet switches, upper and lower rows being composed of pentagonal shaped sheet switches arranged adjacent to each other in the lateral direction and another row of hexagonal shaped sheet switches interposed between said upper and lower rows.

4. The pattern selection device according to claim 3 wherein said three rows of sheet switches are arranged after the model of key arrangement of a typewriter.

5. The pattern selection device according to claim 1 wherein said pattern memorizing means further comprises a pattern memorizing key to be initially operated to thereby memorize the alphabet and symbol patterns selected by the subsequent repeated operation of said sheet switches.

* * * * *